US005847345A

United States Patent [19]

Harrison

[11] Patent Number: 5,847,345

[45] Date of Patent: Dec. 8, 1998

[54] PUSH BUTTON ELECTRICAL SWITCH

[76] Inventor: Charles V. Harrison, 124 Reiffs Mill Rd., Ambler, Pa. 19002

[21] Appl. No.: 909,456

[22] Filed: Aug. 11, 1997

[51] Int. Cl.[6] ..... H01R 33/00

[52] U.S. Cl. ..... 200/284; 200/116; 200/527; 439/224

[58] Field of Search ..... 200/527, 119, 200/66, 536, 303, 307, 284; 439/188, 639, 650, 653, 224, 222

[56] References Cited

U.S. PATENT DOCUMENTS

| | | | |
|---|---|---|---|
| 1,332,378 | 3/1920 | Bramming . | |
| 2,798,907 | 7/1957 | Schnieder . | |
| 3,204,067 | 8/1965 | Brown . | |
| 3,883,710 | 5/1975 | Hanssen et al. . | |
| 4,016,387 | 4/1977 | Aberer | 200/303 |
| 4,239,947 | 12/1980 | Breitung et al. | 200/303 X |
| 4,506,124 | 3/1985 | Rose et al. . | |
| 4,655,522 | 4/1987 | Beck et al. | 439/224 |
| 4,820,179 | 4/1989 | Saijo | 439/224 |
| 4,861,949 | 8/1989 | Bortolloni et al. | 200/307 X |
| 4,891,476 | 1/1990 | Nation et al. | 200/11 R |
| 4,906,808 | 3/1990 | Burgess et al. | 200/527 |
| 4,996,401 | 2/1991 | Park | 200/527 |
| 4,997,999 | 3/1991 | Valenzona | 200/510 |
| 5,001,316 | 3/1991 | Salaman | 200/527 |
| 5,049,709 | 9/1991 | Prickett | 200/527 |
| 5,145,059 | 9/1992 | Park | 200/527 |
| 5,178,265 | 1/1993 | Sepke | 200/528 |
| 5,226,529 | 7/1993 | Valenzona | 200/529 |
| 5,586,645 | 12/1996 | Bartok | 200/527 |

*Primary Examiner*—Renee S. Luebke
*Attorney, Agent, or Firm*—Stuart M. Goldstein

[57] ABSTRACT

A rotary contact push button electrical switch comprising a switch housing and separable independent base. The base is lockably connected to the housing by means of appropriately placed openings and tab means on the sides of the base. The housing has a through opening into which the switch's operating mechanism is disposed. A rotary contact with resilient arms forming arcuate contact points at the end of the arms is rotated by the operating mechanism, when the button which extends through the housing opening is pushed. A nipple at the end of the operating mechanism rotates the rotary contact. Stationary contacts which are mounted on the base, contact the arcuate points of the rotary contact, allowing electrical current to flow alternately between two separate electrical circuits, as the rotary contact is rotated over the stationary contacts. The detent force of the operating mechanism, which maintains the rotary contact in place over the stationary contacts, ensures that current flow can not be interrupted by the application of incidental pressure on the button. The base of the switch has multi-directional and multi-modal electrical connector means, which include electrical connectors located at the bottom of the switch base, through one side of the switch base, and electrical terminal tab connectors extending from the side of the base. The terminal tab connectors can be interconnected with corresponding female terminals in other circuit components, or they can be soldered to wire conductors, or connected with known snap-on or quick connect style connectors. The bottom and side base electrical connectors are adapted to receive either terminal tab connectors or standard wire conductors.

18 Claims, 10 Drawing Sheets

FIG. 13
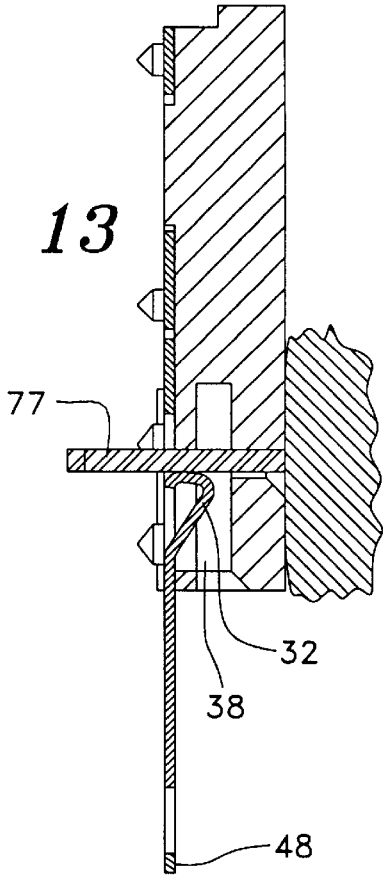
FIG. 14
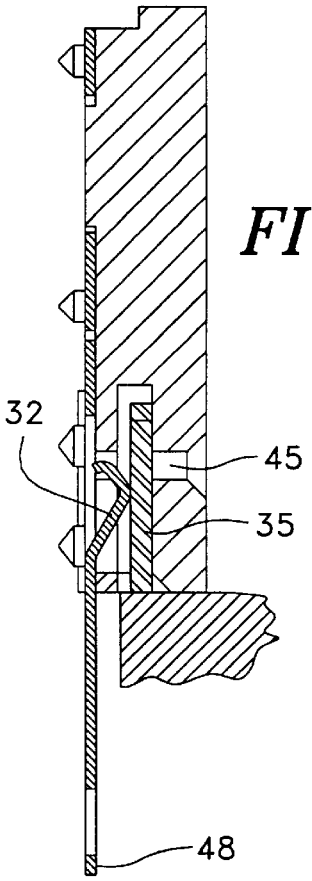
FIG. 15
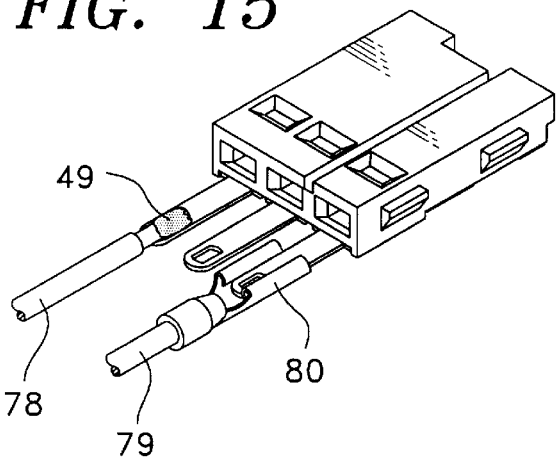
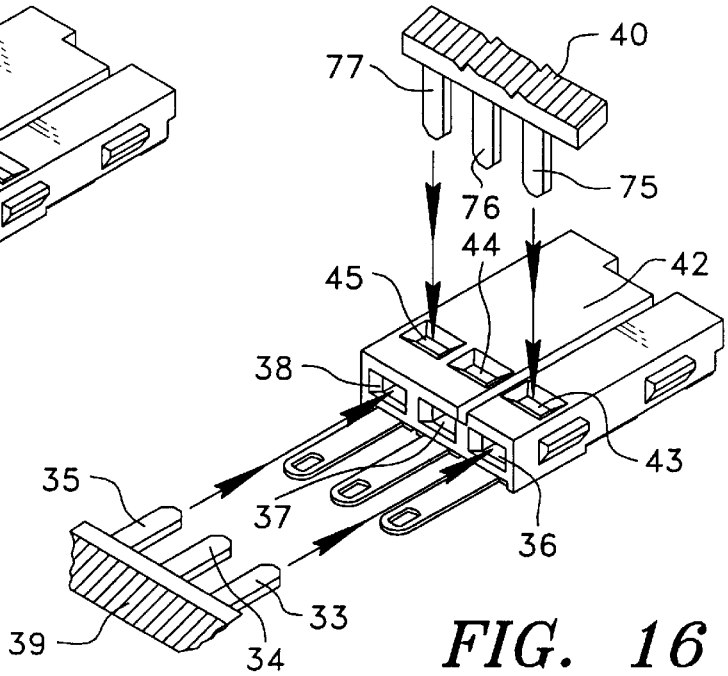
FIG. 16

PUSH BUTTON ELECTRICAL SWITCH

BACKGROUND OF THE INVENTION

Push button electrical switches which employ rotatable contacts to alternately change electrical circuit paths have been in existence for a number of years. Such a switch consists basically of an insulating housing enclosing contact operating mechanism and a rotatable contact configured to allow the flow of electricity through stationary electrical contacts mounted on a base within the housing. Electricity is directed to independent circuits via the stationary contacts to conductor or terminal tab means connected to the switch.

An early switch of this basic design is disclosed in U.S. Pat. No. 1,332,378. More recent examples of such switches are found in U.S. Pat. Nos. 3,041,429, 4,891,476, 4,906,808, 4,996,401, 4,997,999, 5,001,316, 5,049,709, 5,145,059, 5,226,529 and 5,586,645. The switches in this prior art disclose a number of different features and variations in the basic design and operation of the standard rotary contact push button switch. While much of the prior art teaches the use of a switch to alternate circuits upon the pushing of a button, the means to accomplish this end are quite diverse. For instance, there are many different shapes and designs of rotatable contacts and numerous operating mechanisms which employ different components configured in a variety of ways to control the movement of these contacts. The stationary contacts to which the electrical conductors are attached are also configured in various ways, both as a part of the separate lower sections of the switch housings and as independent components attached to the housing. All prior art switches disclose only a single means of electrically connecting a wire conductor or tab terminal to the electrical circuit.

Electrical components with two separate means of providing electric connection are disclosed in the prior art. Examples of such connectors are found in U.S. Pat. Nos. 4,655,522, 4,671,600, 4,820,179 and 4,946,401. These patents teach the use of dual directional electrical connectors.

SUMMARY OF THE INVENTION

It is the object of the present invention to overcome the limitations and disadvantages of prior rotary contact push button electrical switches.

It is another object of the present invention to provide a switch with an efficient rotatable operating mechanism to effect positive electrical contact within the switch.

It is still another object of the present invention to provide a switch with a rotatable contact which provides for discreet and positive increments to allow effective alternating electrical circuitry.

It is a further object of the present invention to provide a switch which comprises an independent base section which is lockably connected to the housing of the switch to maintain all components securely in place.

It is an object of the present invention to provide a switch which will maintain an interrupted flow of electric current, even when incidental pressure is applied to its operating mechanism.

It is another object of the present invention to provide a switch with an electrical connector to permit electrical circuit connection with either a wire conductor or terminal tab connector.

It is an object of the present invention to provide a switch with an electrical connector with multi-directional connector means to allow easy and effective connection to a wire conductor or terminal tab connector.

It is still another object of the present invention to provide a switch with an electrical connector with up to seven means to easily and effectively connect with a wire conductor or terminal tab connector.

It is another object of the present invention to provide a switch whose components are easily and rapidly assembleable.

It is still another object of the present invention to provide a switch whose components are designed for long life and usage.

It is a further object of the invention to provide an electrical connector with multi-directional, multi-modal connection means to permit electrical circuit connection with either a wire conductor or terminal tab connector.

It is a further object of the present invention to provide an electrical connector with up to seven means to easily and effectively connect with a wire conductor or terminal tab connector.

The present invention discloses a rotary contact push button electrical switch comprising a switch housing and separable independent base. The base is lockably connected to the housing by means of appropriately placed openings and tab means on the sides of the base, beneath the bottom surface of the switch housing. The housing itself has a through opening into which the switch's operating mechanism is disposed. A rotary contact with resilient arms forming arcuate contact points at the end of the arms is rotated by the operating means, when the button which extends through the housing opening is pushed. A nipple at the end of the operating mechanism rotates the rotary contact. Stationary contacts which are mounted on the base, contact the arcuate points of the rotary contact, allowing electricity to flow alternately between two separate electrical circuits, as the rotary contact is rotated over the stationary contacts.

Significantly, the configuration of the switch's operating mechanism solves a problem inherent in many push switches. Application of the slightest pressure on the actuating button in such switches causes an interruption of current flow and a loss or stoppage of current through the circuit. Since the operating mechanism of the present invention employs spring loaded detent surface forces to maintain the rotary contact over and on the stationary contacts, current flow through the switch can not be interrupted by inadvertent contact with or application of incidental pressure on the button. Current flow is continuously maintained until sufficient pressure is applied to the button to overcome the detent forces of the operating mechanism. Only then will there be movement of the rotary contact and disengagement with the stationary contacts.

The base of the switch has multi-directional and multi-modal electrical connector means, which include electrical connectors located at the bottom of the switch base, through one side of the switch base, and electrical terminal tab connectors extending from the side of the base. The terminal tab connectors can be interconnected with corresponding female terminals in other circuit components, or they can be soldered to wire conductors, or connected with known snap-on connectors. The bottom and side base electrical connectors are adapted to receive either terminal tab connectors or standard wire conductors. For example the electrical wire connector disclosed in co-pending U.S. patent application Ser. No. 08/795,252 is readily adaptable for use in the present invention and can accept either a sold or strand wire conductor or a terminal tab connector.

The multi-directional, multi-modal electrical connector integral with the switch base can also be employed for use with other electrical circuit components such as terminal receptacles and electrical fixtures.

The novel features which are considered as characteristic of the invention are set forth in particular in the appended claims. The push button switch itself, however, both as to its design, construction, and use, together with additional features and advantages thereof, are best understood upon review of the following detailed description with reference to the accompanying drawings.

BRIEF DESCRIPTION OF THE DRAWINGS

FIG. 13 is a side section of the base showing an electrical terminal tab inserted through an electrical connection at the bottom of the base.

FIG. 14 is a side section of the base showing an electrical terminal tab inserted through an electrical connector at the front of the base.

FIG. 15 is an isometric view showing the use of snap-on electrical connectors and solder for attachment to base terminal tabs.

FIG. 16 is an isometric view showing electrical connection to the base in planes both horizontal and vertical to the base.

DETAILED DESCRIPTION OF THE INVENTION

Figure 1:
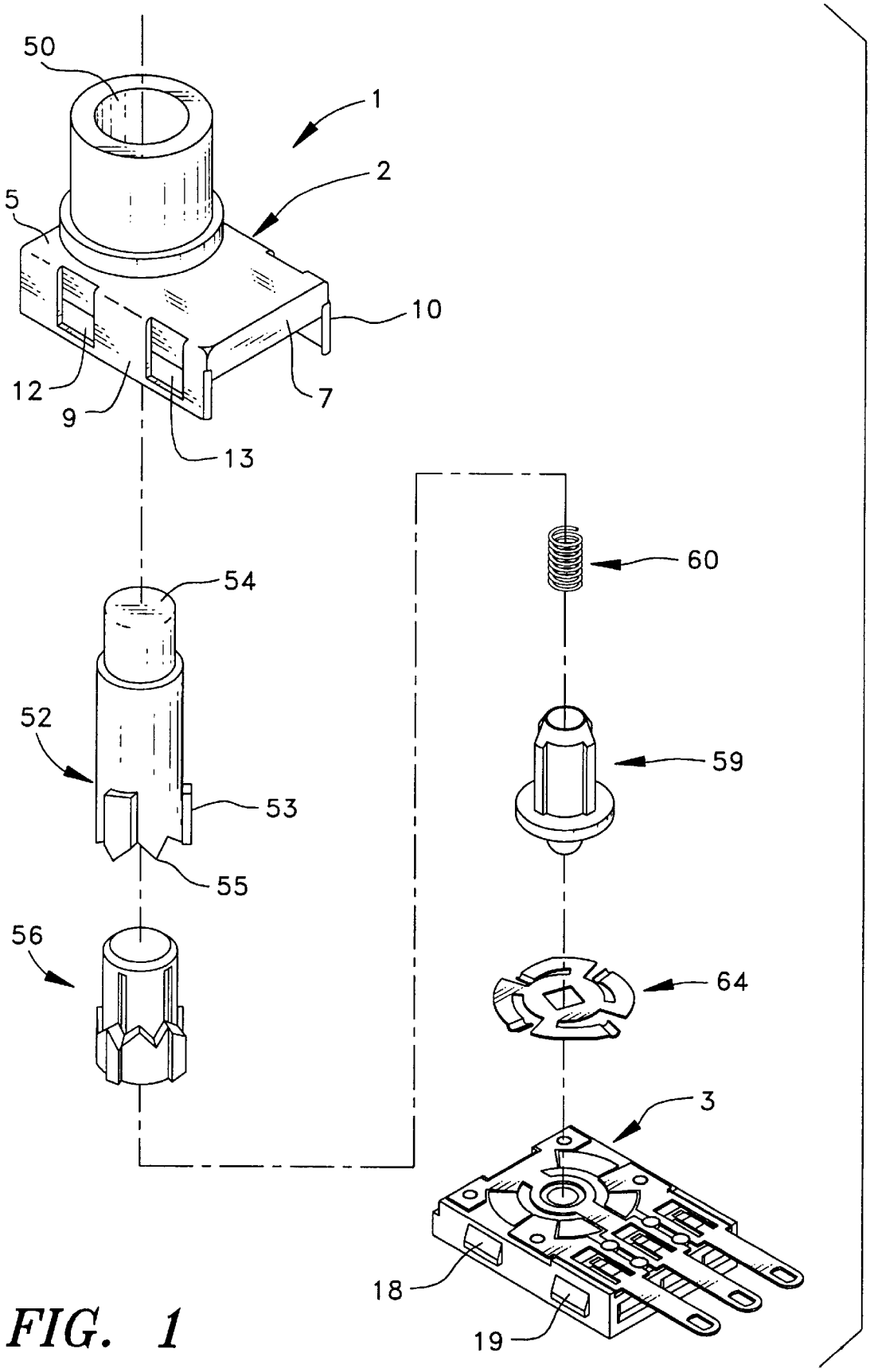
FIG. 1 is an exploded view showing the alignment of the components of the switch.
Figure 2:
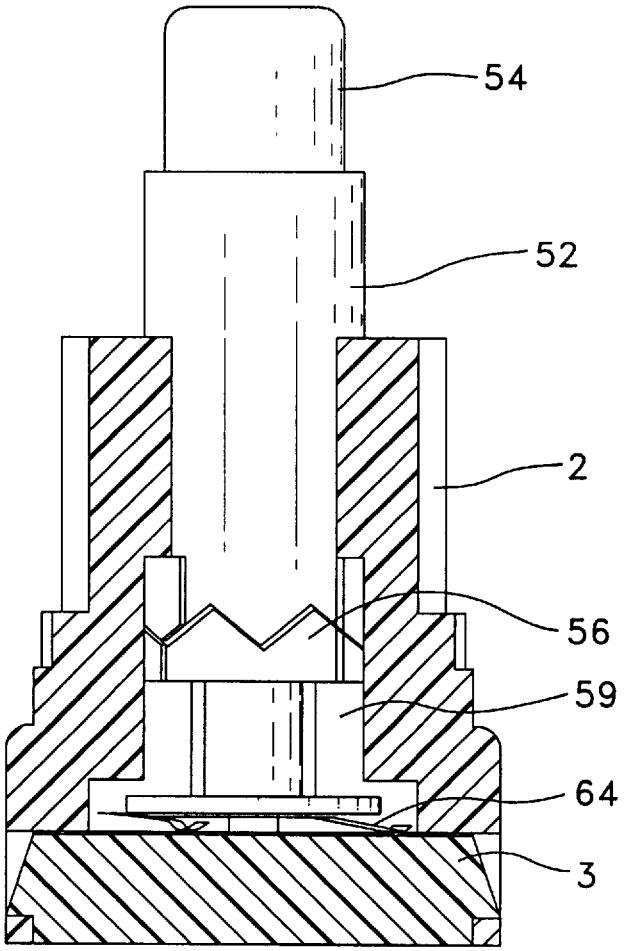
FIG. 2 is a partial section view of the housing and base.
Figure 3:
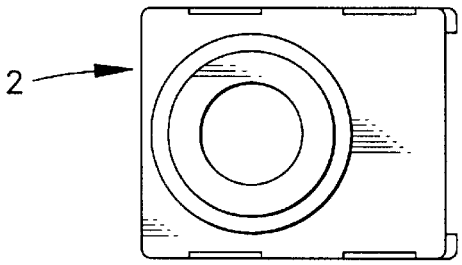
FIG. 3 is a top view of the housing.
Figure 4:
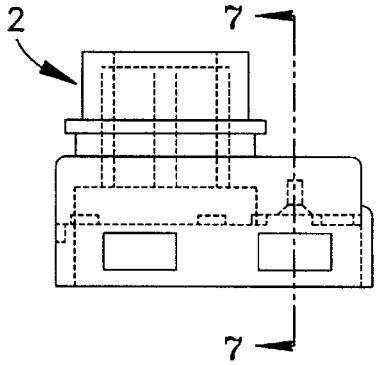
FIG. 4 is a side elevation view of housing.
Figure 5:
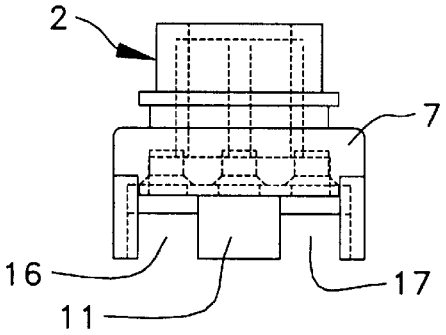
FIG. 5 is a front elevation view of the housing.
Figure 6:
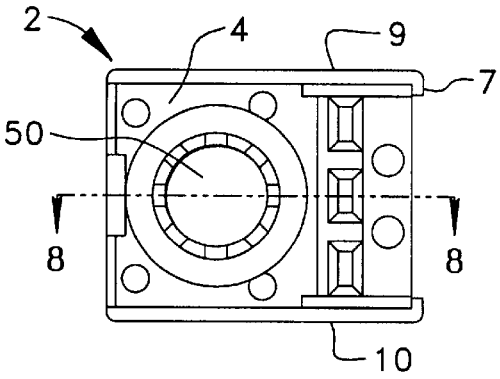
FIG. 6 is a bottom view of the housing.
Figure 7:
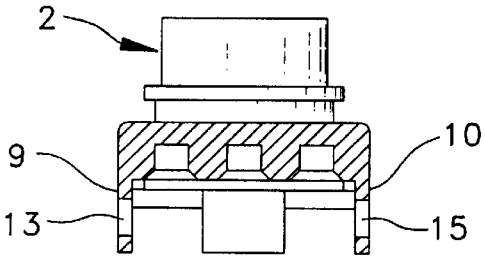
FIG. 7 is a front section view of the housing.
Figure 8:
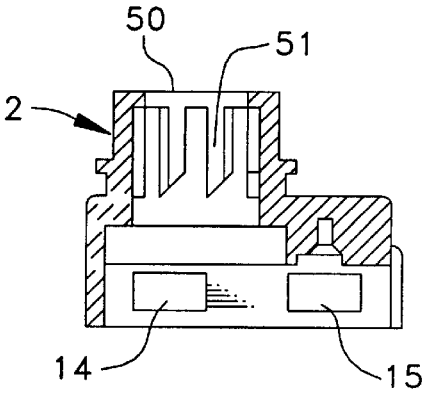
FIG. 8 is a side section view of the housing.
Figure 9:
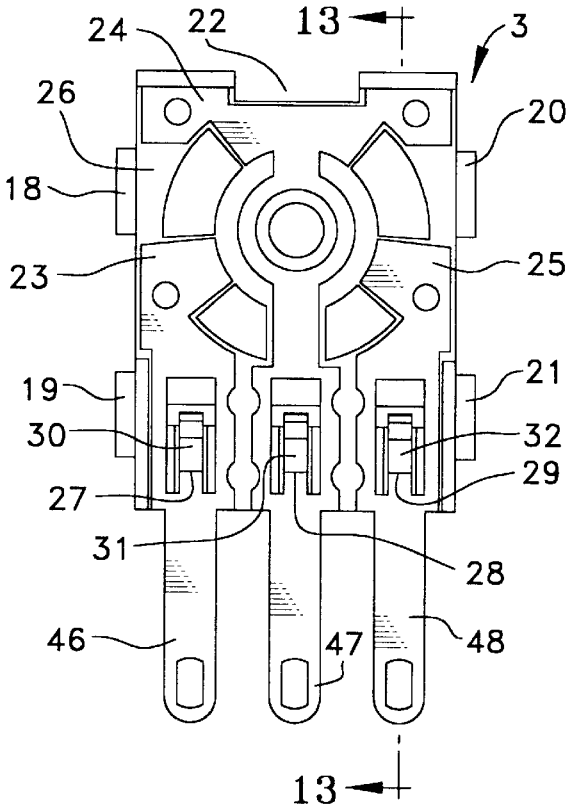
FIG. 9 is a top view of the base.
Figure 10:
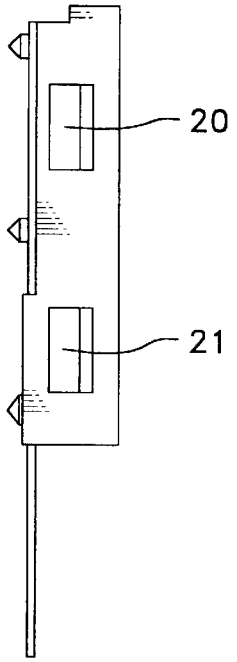
FIG. 10 is a side elevation view of the base.
Figure 11:
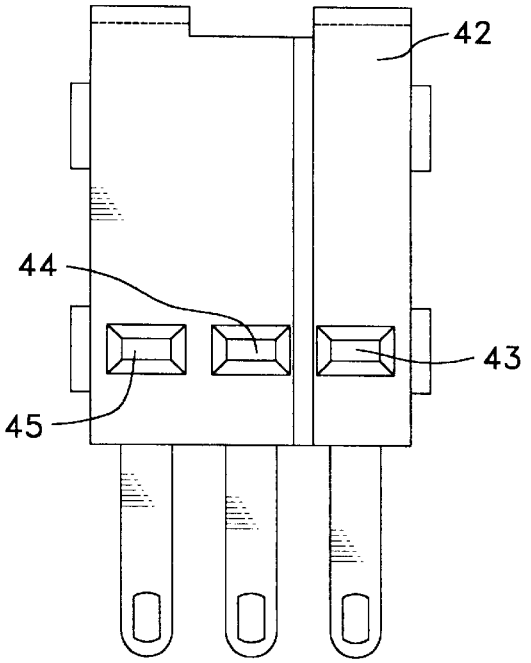
FIG. 11 is a bottom view of the base.
Figure 12:
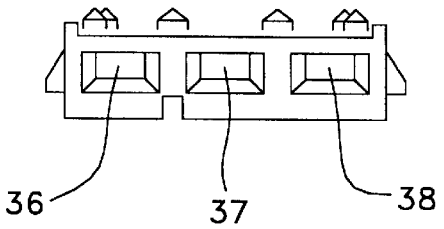
FIG. 12 is a front elevation view of the base.
Figure 17:
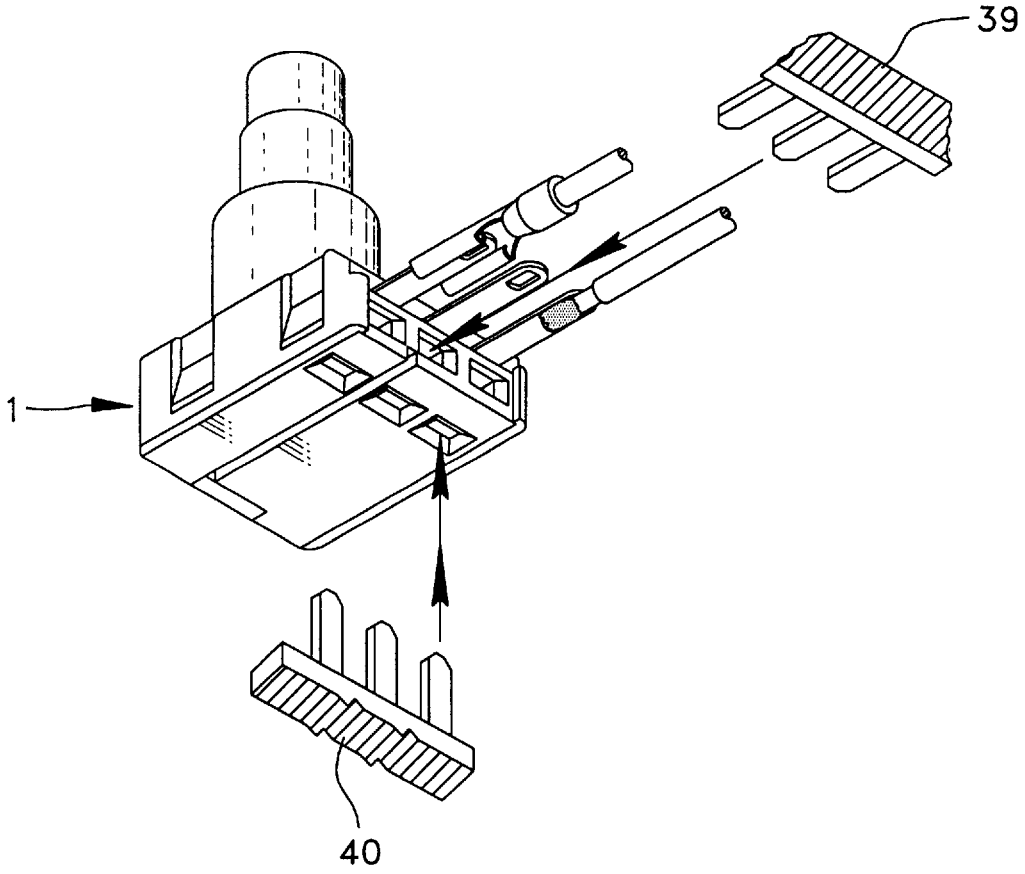
FIG. 17 is isometric view showing the various means for electrical connections to the switch.
Figure 18:
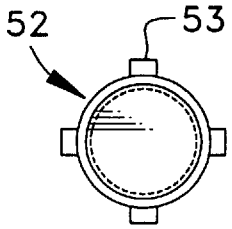
FIG. 18 is a top view of the plunger.
Figure 21:
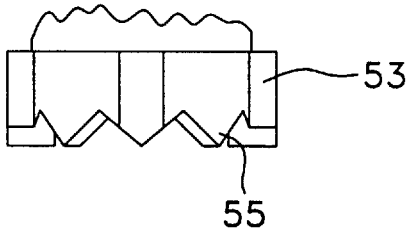
FIG. 21 is an enlarged view of the second end of the plunger.
Figure 19:
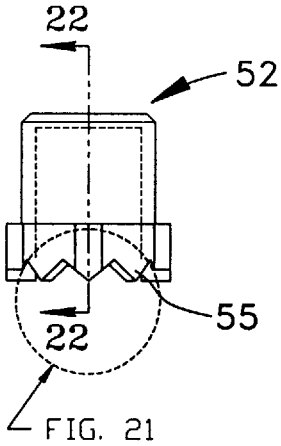
FIG. 19 is a side elevation view of the plunger.
Figure 22:
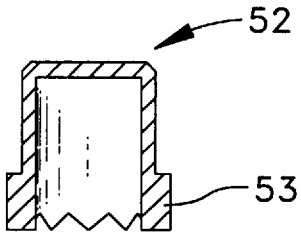
FIG. 22 is a side section of the plunger.
Figure 20:
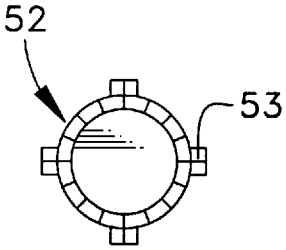
FIG. 20 is a bottom view of the plunger.
Figure 23:
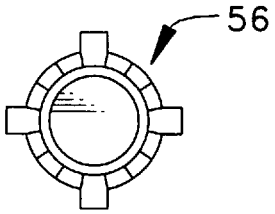
FIG. 23 is a top view of the plunger sleeve.
Figure 24:
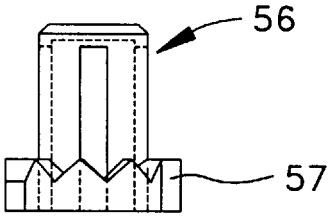
FIG. 24 is a side elevation view of the plunger sleeve.
Figure 26:
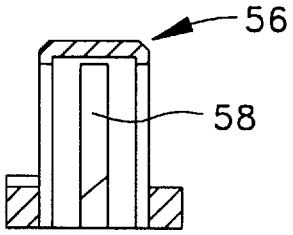
FIG. 26 is a section view of the plunger sleeve.
Figure 25:
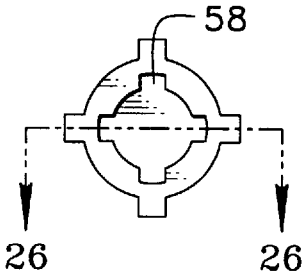
FIG. 25 is a bottom view of the plunger sleeve.
Figure 27:
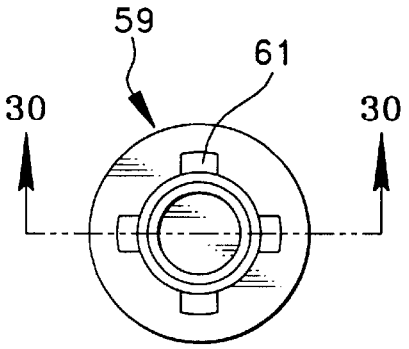
FIG. 27 is a top view of the rotor sleeve.
Figure 28:
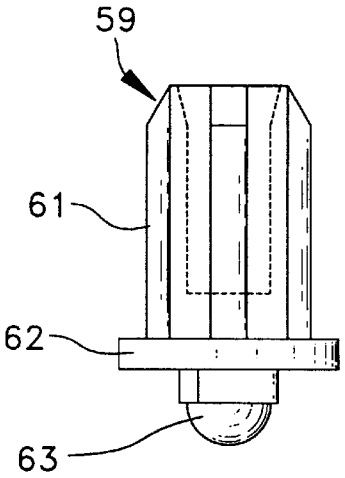
FIG. 28 is a side elevation view of the rotor sleeve.
Figure 30:
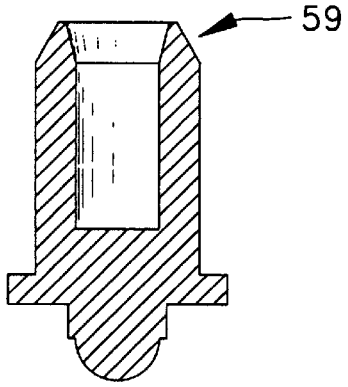
FIG. 30 is a section view of the rotor sleeve.
Figure 29:
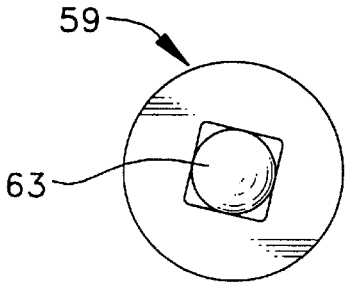
FIG. 29 is a bottom view of the rotor sleeve.
Figure 31:
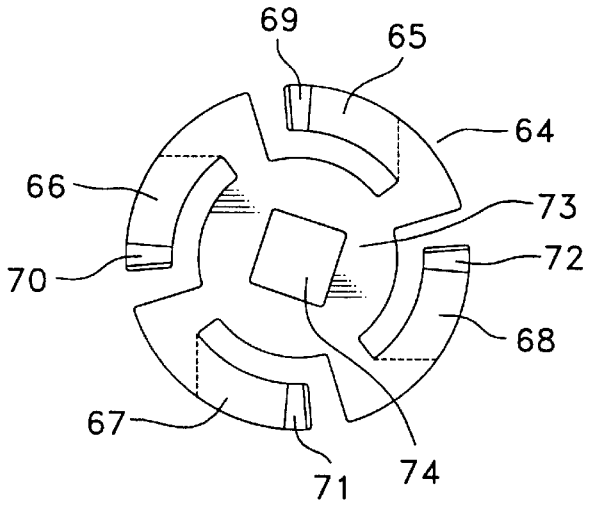
FIG. 31 is a top view of the rotary contact.
Figure 32:
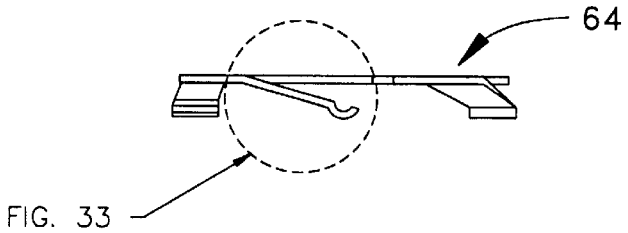
FIG. 32 is a partial side elevation view of the rotary contact.
Figure 33:
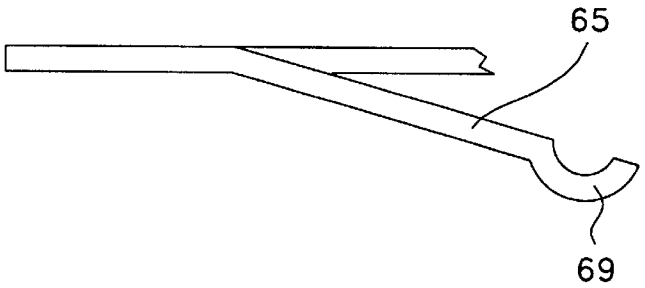
FIG. 33 is an enlarged view of an arm of the rotary contact.
Figure 34:
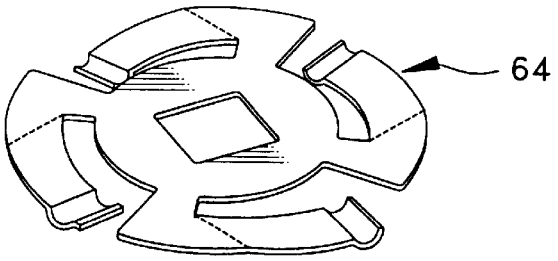
FIG. 34 is an isometric view of the rotary contact.

Push button switch 1 comprises switch housing 2 and base 3. These components are made of non-conductive material, for instance molded plastic. Housing 2 has a bottom surface 4, top surface 5, and front side surfaces 7. Side wall members 9, 10 and back side tab 11 define side openings 12, 13 and 14, 15 and 16, 17. Base 3 comprises side tabs 18, 19 and 20, 21 and back side opening 22.

Housing 2 is adapted to overlay and interconnect with base 3. This interconnection is accomplished by the locking connections formed by the snap-in insertion of side tabs 18 and 19 into side openings 12 and 13 respectively, side tabs 20 and 21 into side openings 14 and 15 respectively, and back side tab 11 into backside opening 22.

Stationary contact pieces 23, 24 and 25 are mounted on and attached onto top surface 26 of base 3 by known means. Electrical connectors 27, 28 and 29, located in base 3, are formed in part from stationary contacts 23, 24 and 25 respectively. Contacts 30, 31 and 32 forming part of electrical connector 27, 28 and 29 respectively, engage and secure electrical terminal tab connectors 33, 34 and 35 from a circuit component 39, which are inserted into the switch at electrical connector openings 36, 37 and 38 respectively in a plane horizontal to top surface 26 of base 3. Connectors 27, 28 and 29 are also adapted to receive electrical wire conductors through openings 36, 37 and 38.

Electrical connection to base 3 can also be accomplished by use of electrical connector means which are located through bottom surface 42 of base 3. Electrical terminal tab connectors 75, 76 and 77 from a circuit component 40 are inserted into electrical connector openings 43, 44 and 45 respectively, in a plane perpendicular to top surface 26. Contacts 30, 31 and 32 of electrical connectors 27, 28 and 29 engage and secure terminal tabs 75, 76 and 77 respectively. Electrical wire conductors can also be received and secured through openings 43, 44 and 45.

Terminal tab connectors tabs 46, 47 and 48 provide further means to electrically attach switch 1 to an electrical circuit. Tabs 46, 47 and 48, mounted and secured to stationary contacts 23, 24 and 25 respectively, are adapted to be inserted and locked into corresponding electrical female connectors in circuit components. Tabs 46, 47 and 48 are also adapted to be attached to a circuit by securing electrical wire conductors, such as 78 and 79, with known snap-on connectors 80 or by the use of electrically conductive solder 49 or like attachment means.

Thus, switch 1 is readily adaptable for inclusion into an electrical circuit by seven distinct and different means, depending on the circumstances and necessity of use. It is contemplated that other electrical circuit components, like terminal boards, can also employ the multi-directional, multi-modal electrical connector system disclosed herein.

Housing 2 contains through opening 50 with ridge cams 51 integral with the internal surface of the opening. Plunger 52 is hollow and has cams 53 around its lower end. Button 54 is located at one end of plunger 52 and has teeth 55 at its second end. Plunger 52 is disposed within through opening 50 such that button 54 extends through the opening and cams 53 are located in between every other ridge cam 51.

Plunger sleeve 56 is cylindrical in shape, having a toothed platform 57 on its lower end. Plunger sleeve 56 has grooved channels 58, along its internal surface and is disposed within plunger 52, such that tooth platform 57 interconnects with plunger teeth 55.

Rotor sleeve 59 is hollow, to allow insertion of spring 60. Rotor sleeve 59 has ridges 61 along its outer surface and platform stop 62 at its lower end. Nipple 63 is integral with and extends from platform stop 62. Rotor sleeve 59 and spring 60 are disposed within plunger sleeve 56. Ridges 61 of rotor sleeve 59 are inserted into grooved channels 58 of plunger sleeve 56. In this manner, rotor sleeve 59 is slideable mounted and spring biased within plunger sleeve 56.

Rotary electrical contact 64, made of a conductive metal, like copper, is generally circular in configuration. Rotary contact 64 has resilient arms 65, 66, 67 and 68, each with arcuate contacts 69, 70, 71 and 72 at their respective ends. Arms 65, 66, 67 and 68 are angled downward from central body portion 73 of rotary contact 64. Opening 74 in central body portion 73 is shown as being square, but it can be of any shape, as long as it is correspondingly configured to the shape of the nipple 63 of rotor sleeve 59. Nipple 63 is disposed within opening 74 and is the component which causes the rotation of rotary contact 64.

The operation of switch 1 is as follows. The switch is positioned in an electrical circuit by the insertion of electrical terminal tab connectors 33, 34 and 35 or wire conductors into electrical connector openings 36, 37 and 38, or by insertion of electrical terminal tab connectors 75, 76 and 77 or wire conductors into electrical connector openings 43, 44 and 45, or by insertion of terminal tab connectors 46, 47 and 48 into appropriate circuit components, or by use of a snap-on connector or quick connect style connector 80 or soldered attachment 49 with wire conductors 78 and 79 respectively.

Inadvertent contact with or application of incidental pressure on button 54 will be insufficient to cause movement of rotary contact 64 and, as long as rotary contact 64 remains in place on and over stationary contacts 23 and 24 or 24 and 25, there is no interruption of current flow through switch 1. Rotary contact 64 will not be caused to rotate until sufficient pressure is applied to button 54 to overcome the spring loaded interacting detent surface forces of plunger 52, plunger sleeve 56 and rotor sleeve 59—which forces retain rotary contact 64 in position.

Pushing button 54 with sufficient pressure to overcome the detent surface forces contemporaneously causes plunger 52 to move down through opening 50, along ridge cams 51, thus rotating plunger sleeve 56 and rotor sleeve 59 and its nipple 63. Rotary contact 64, spring biased against top surface 26 of base 3, similarly rotates over the surface. Rotation of rotary contact 64 allows completion of two distinct electrical circuits. When, for example, arcuate contacts 69 and 70 of rotary contact 64 are in position over and are in contact with stationary contacts 23 and 24, an electrical circuit is completed through electrical connectors 27 and 28 or terminal tabs 46 and 47. Arcuate contacts 71 and 72 are not in contact with any stationary contacts. When rotary contact 64 is rotated upon a push of button 54, arcuate contacts 69 and 70 rotate over and off stationary contacts 23 and 24 and arcuate contacts 71 and 72 rotate over and onto stationary contacts 24 and 25, thus completing a second electrical circuit through electrical connectors 28 and 29 or terminal tabs 47 and 48. Further pushing of button 54 continues to rotate rotary contact 64 to intermittently complete the two electrical circuits.

Certain novel features and components of this invention are disclosed in detail in order to make the invention clear in at least one form thereof. However, it is to be clearly understood that the invention as disclosed is not necessarily limited to the exact form and details disclosed, since it is apparent that various modifications and changes may be made without departing from the spirit of the invention.

What is claimed:

1. A push button switch comprising a housing, operating means controlling flow of electrical current within the switch, and a switch base, said switch comprising:

(a) first electrical connector means for receiving and retaining an electrical conductor member in a first plane, said first electrical connector means comprising a terminal tab in the first plane, said terminal tab having a single integrally extending cantilever contact member located within the switch base, said contact member having multiple electrical contact surfaces through which electrical current is routed, (b) second electrical connector means within the switch base for receiving and retaining an electrical conductor member in a second plane parallel to the first plane, said second electrical connector means routing electrical current from the conductor member directly through a contact surface of the contact member, said contact surface being in a plane parallel to the first and second planes; and (c) third electrical connector means within the switch base for receiving and retaining an electrical conductor member in a plane perpendicular to the first plane, said third electrical connector means routing electrical current from the conductor member directly through a second contact surface of the contact member, said second contact surface being in a plane perpendicular to the first and second planes.

2. The push button switch in claim 1 in which said second electrical connector means comprises first opening means in the base for receiving an electrical conductor member.

3. The push button switch in claim 2 in which said third electrical connector means comprises second opening means in the base for receiving an electrical conductor member.

4. The push button switch in claim 1 in which the first electrical connector means is to be inserted into a corresponding female connector means of an electrical conductor member.

5. The push button switch in claim 1 in which the first electrical connector means is secured to an electrical conductor member by substance attachment means.

6. The push button switch in claim 5 in which the substance attachment means is electrically conductive solder.

7. The push button switch in claim 1 in which said third electrical connector means comprises second opening means in the base for receiving an electrical conductor member.

8. The push button switch in claim 1 in which the first electrical connector means is secured to an electrical conductor member by mechanical attachment connectors.

9. An electrical connector comprising a base, said electrical connector further comprising:

(a) first electrical connector means for receiving and retaining an electrical conductor member in a first plane, said first electrical connector means comprising a terminal tab in the first plane, said terminal tab having a single integrally extending cantilever contact member located within the base, said member having multiple electrical contact surfaces through which electrical current is routed;

(b) second electrical connector means within the base for receiving and retaining an electrical conductor member in a second plane parallel to the first plane, said second electrical connector means routing electrical current from the conductor member directly through a contact surface of the contact member, said contact surface being in a plane parallel to the first and second planes; and (c) third electrical connector means within the base for receiving and retaining an electrical conductor member in a plane perpendicular to the first plane, said third electrical connector means routing electrical current from the conductor member directly through a second contact surface of the contact member, said second contact surface being in a plane perpendicular to the first and second planes.

10. The electrical connector in claim 9 in which said second electrical connector means comprises first opening means in the base for receiving an electrical conductor member.

11. The electrical connector in claim 10 in which said third electrical connector means comprises second opening means in the base for receiving an electrical conductor member.

12. The electrical connector in claim 9 in which the first electrical connector means is to be inserted into a corresponding female connector means of an electrical conductor member.

13. The electrical connector in claim 9 in which the first electrical connector means is secured to an electrical conductor member by substance attachment means.

14. The electrical connector in claim 13 in which the substance attachment means is electrically conductive solder.

15. The electrical connector in claim 9 in which said third electrical connector means comprises second opening means in the base for receiving electrical conductor member.

16. The electrical connector in claim 9 in which the base is a switch base for an electrical switch.

17. The electrical connector in claim 9 in which the base is a terminal base for an electrical terminal receptacle.

18. The electrical connector in claim 9 in which the first electrical connector means is secured to an electrical conductor member by mechanical attachment connectors.

* * * * *